US005474487A

United States Patent [19]

Roush et al.

[11] Patent Number: 5,474,487

[45] Date of Patent: Dec. 12, 1995

[54] BRASSIERE STRAP BRIDGING AND SUPPORT MEMBER

[76] Inventors: Warren H. Roush; Anne F. Roush, both of 2013-C Powers Ferry Rd., Marietta, Ga. 30067

[21] Appl. No.: 199,564

[22] Filed: Feb. 22, 1994

Related U.S. Application Data

[63] Continuation-in-part of Ser. No. 39,852, Mar. 30, 1993, abandoned.

[51] Int. Cl.[6] ..... A41C 3/12

[52] U.S. Cl. ..... 450/86; 2/73; 2/267; 2/101; 2/112; 2/117

[58] Field of Search ..... 2/2, 2.5, 73, 267, 2/268, 160, 22, 23, 24, 16, 406, 107, 117, 101; 450/30, 31, 32, 86, 102, 103, 104; 224/264

[56] References Cited

U.S. PATENT DOCUMENTS

| | | | |
|---|---|---|---|
| 1,631,694 | 6/1927 | Rick . | |
| 2,505,272 | 4/1950 | Blalock et al. . | |
| 2,551,255 | 5/1951 | Engel | 2/2 |
| 2,608,326 | 8/1952 | Spector | 224/264 |
| 3,788,314 | 1/1974 | Noreen | 450/104 |
| 4,354,780 | 10/1982 | Hayes | 2/24 |
| 4,441,211 | 4/1984 | Donzis | 2/69 |
| 4,472,838 | 9/1984 | Pompa . | |
| 4,612,935 | 9/1986 | Greifer . | |
| 4,638,513 | 1/1987 | Woods . | |
| 4,764,988 | 8/1988 | Reaver . | |
| 4,795,399 | 1/1989 | Davis . | |
| 4,795,400 | 1/1989 | Greenberg . | |
| 4,945,576 | 8/1990 | Melton . | |

FOREIGN PATENT DOCUMENTS

| | | | |
|---|---|---|---|
| 1118197 | 8/1952 | France | 1/1 |

*Primary Examiner*—Jeanette E. Champman
*Attorney, Agent, or Firm*—James A. Hinkle

[57] ABSTRACT

A support for a brassiere shoulder strap has an elongate bridge plate of desired rigidity with a curvature sized and shaped to form-fit on a woman's shoulder beneath a brassiere strap between an area proximate the clavicle bone in the front and a position proximate a downward-curving rear portion of the shoulder. A bottom surface of the bridge plate is provided with walls, at least two of which are recessed, surrounding a cushion receptacle into which a cushion pad can be inserted and held in cushioning relationship between the bridge plate and the woman's shoulder. The cushion pad can be attached to and detached from the bridge plate conveniently and easily for cleaning, servicing and replacement. The elongate bridge plate can be shaped variously, preferably having a generally elliptical form. Each shoulder strap of a brassiere is positioned on top of a bridge plate and extended down through a T-shaped strap-attachment bay and onto a shoulder of the woman forwardly and rearwardly. Cushion pads with different thicknesses, widths and other characteristics can be provided and utilized optionally and interchangeably for different levels of breast weight and physical activity of users. Orifices for ventilation and for attachment of decorations can be provided in the bridge plate.

22 Claims, 4 Drawing Sheets

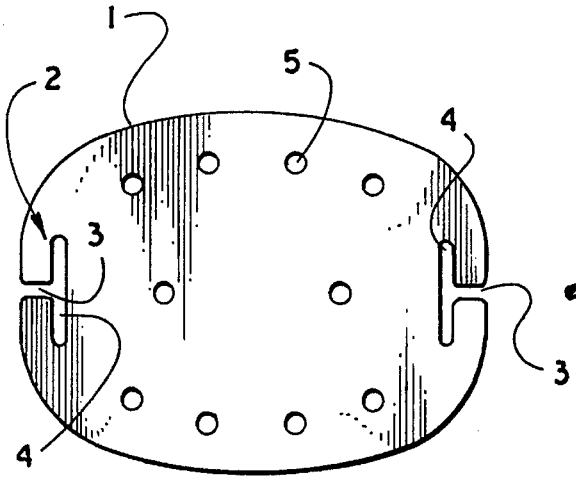
Fig_1
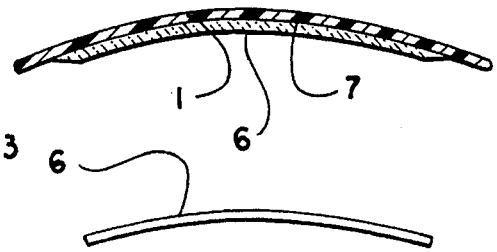
Fig_2
Fig_9
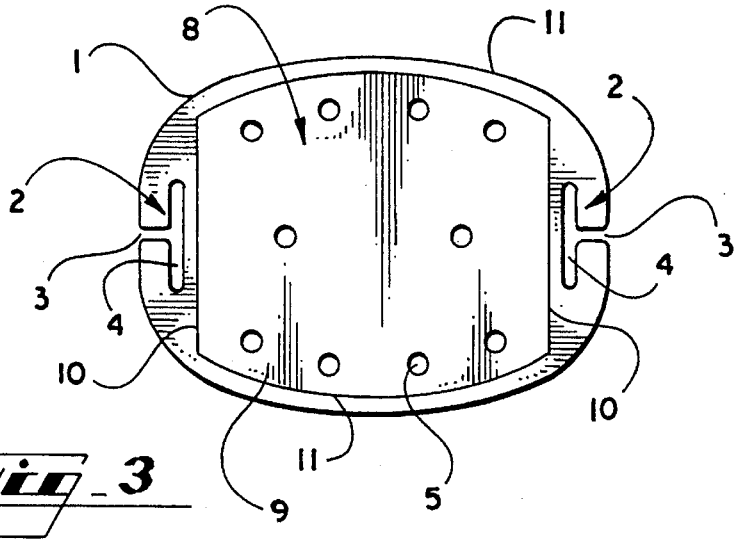
Fig_3
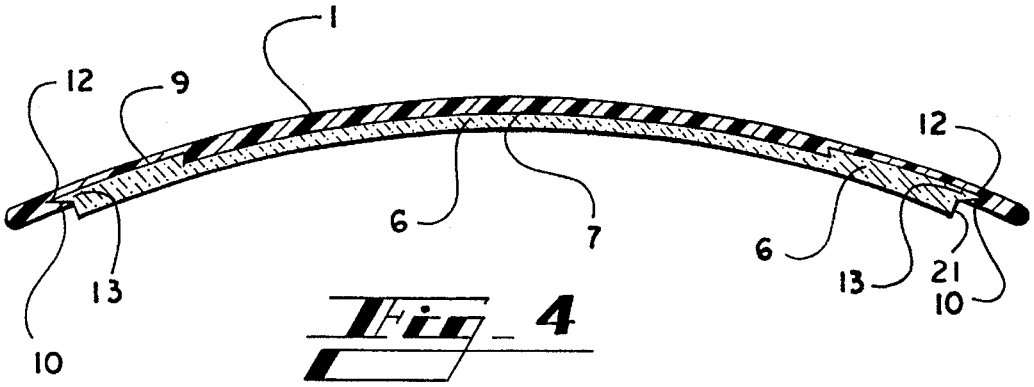
Fig_4

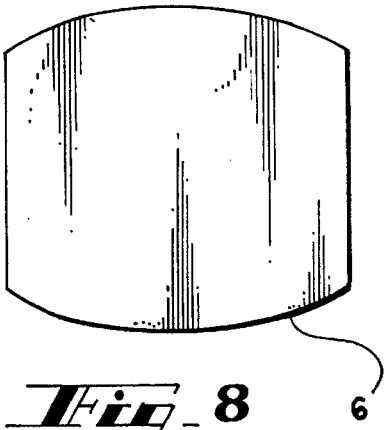
Fig_8
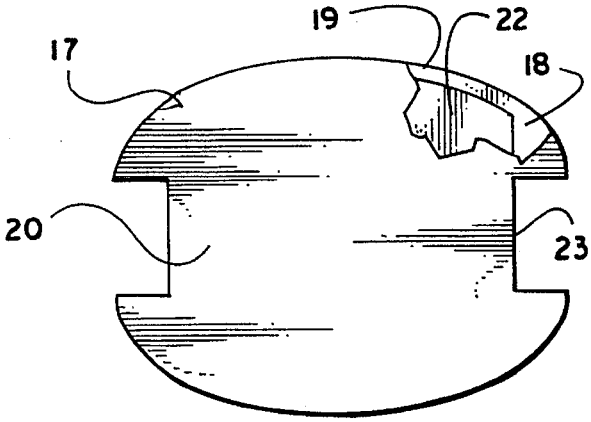
Fig_12
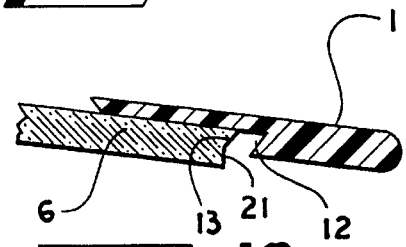
Fig_10
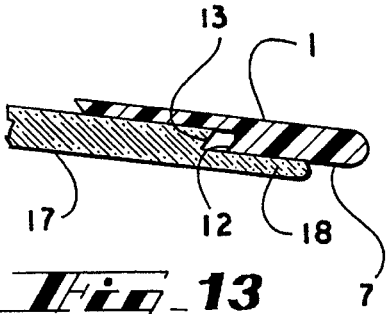
Fig_13
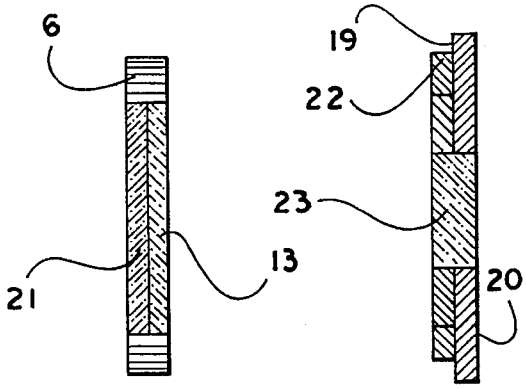
Fig_11
Fig_14
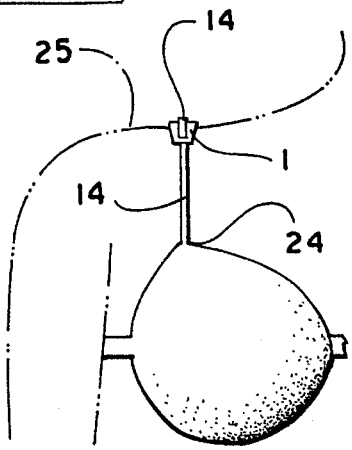
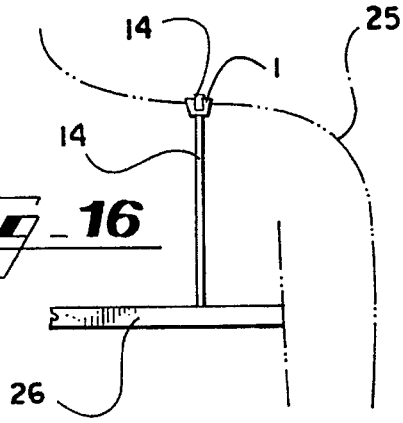
Fig_16
Fig_15

BRASSIERE STRAP BRIDGING AND SUPPORT MEMBER

RELATED PATENT DOCUMENTS

This is a continuation-in-part of U.S. application Ser. No. 08/039,852, filed Mar. 30, 1993, by Warren H. Roush and Anne F. Roush, entitled "Brassiere Strap Bridging And Support Member", now abandoned.

BACKGROUND OF THE INVENTION

I. Field of the Invention.

The present invention relates generally to the field of brassiere straps and more particularly to a weight-distribution and cushioning support which protects women's shoulders against discomfort and injury from suspension of weight of breasts by brassiere shoulder straps.

II. Description of the Prior Art.

Support of medium-to-large sized breasts by brassiere straps has caused problems of disfigurement of shoulder tissues, unsightly appearance, discomfort and occasional injury since the advent of brasseries. Wide brassiere straps do not always solve the problem because they do not distribute weight evenly over wide areas. Nor are they attractive and feminine enough for most use conditions. Various forms of padding have been devised but have not become popular for a number of reasons.

A strap-bearing pad described in U.S. Pat. No. 4,795,399 by Davis had a top rigid layer and a bottom soft layer. A brassiere strap was held between pairs of tabs at each end. This had merit but the pad bottom layer was attached permanently to the top layer. Whenever the bottom layer became unusable with wear and contamination with skin discharge and items with which it was washed or stored, the top portion had to be discarded with the bottom portion. It was difficult to find a suitable bottom portion that could be cleaned well and still provide adequate cushioning. The Davis device was relatively thick and limited to athletic and nursing uses, rather than being amenable to aesthetic uses by women with breasts large enough to require firm support.

U.S. Pat. No. 3,050,734 granted to Dopyera also described a shoulder-strap pad which had a cushioned bottom fixed to a top portion. Its strap-attachment method was different from the Davis patent. But its permanent attachment of a bottom cushion had the same use-life and aesthetic problems of the Davis patent.

A shoulder protector for shoulder straps described in U.S. Pat. No. 2,501,749 by Trent was limited to a pad with a particular type of embedded attachment member. It did not describe a cushioning member nor an attachable cushion member that is removably attachable to a shoulder pad having convenient strap-attachment means taught by this invention.

SUMMARY OF THE INVENTION

In accordance with the present invention, it is contemplated that the problems that have existed and that continue to exist in this field, objectives of this invention are to provide a brassiere-shoulder-strap support which:

Has a removably-attachable cushion pad that can be detached for cleaning, servicing and replacement;

Has a curvature which form-fits a woman's shoulder beneath a brassiere strap and will not restrict circulation of blood in the upper torso of the wearer;

Has a rigid bridge that is sized and shaped to extend sufficiently rearward from proximate the clavicle bone and over a sufficiently wide area to distribute weight of breasts held by the brassiere strap without cutting into, indenting or injuring shoulder, skin and bone tissues;

Prevents pain and discomfort due to excessive brassiere-strap pressure;

Allows leaving brassiere-shoulder-strap supports on a brassiere when it is not being worn in order to use them fast and conveniently without reattachment when a brassiere is worn again;

Makes brassiere straps easily and conveniently attachable and removable, and is not destructive to the straps as are other devices utilizing harsh attachment means, such as hook and loop fastening devices;

Makes lace, perfume packets and other desired material attachable and removable with ease and convenience;

Has cushion pads with a variety of thicknesses and widths for different conditions and uses with ease by women with different physical characteristics;

Allows use of more rigid and supportive brassiere straps without irritation, indentation, pain or injury;

Allows use of cushion pads which are selectively hypoallergenic and will not cause allergic skin reactions;

Has removable cushion pads to which anti-irritant, fragrances and other substances can be applied directly as desired;

Prevents slippage of brassiere straps from shoulders;

Allows transfer of brassiere-shoulder-strap supports from one brassiere to another easily and conveniently; and which Has both rigidly-bridging and effectively-cushioning components which can be designed especially for athletic and nursing applications without redesign of brasseries for different levels of breast-weight support and physical activity.

This invention accomplishes the above and other objectives with a brassiere-shoulder-strap support having an elongate bridge plate of desired rigidity with a curvature sized and shaped to form-fit on a woman's shoulder beneath a brassiere strap between an area proximate the clavicle bone in the front and a position proximate a downward-curving rear portion of the shoulder. A bottom surface of the bridge plate is provided with walls, at least two of which are recessed, surrounding a cushion receptacle into which a cushion pad can be inserted and held in cushioning relationship between the bridge plate and the woman's shoulder. The cushion pad can be attached to and detached from the bridge plate conveniently and easily for cleaning, servicing and replacement. The elongate bridge plate can be shaped variously, preferably having a generally elliptical form. Each shoulder strap of a brassiere is positioned on top of a bridge plate and extended down through a T-shaped strap-attachment bay and onto a shoulder of the woman forwardly and rearwardly. Cushion pads with different thicknesses, widths and other characteristics can be provided and utilized optionally and interchangeably for different levels of breast-weight and physical activity of users. Orifices for ventilation and for attachment of decorations can be provided in the bridge plate. Further, the present invention provides a support for the brassiere strap which is feminine, sleek and unobtrusive in use.

Other objects, advantages and capabilities of the invention will become apparent from the following description taken in conjunction with the accompanying drawings showing preferred embodiments of the invention.

BRIEF DESCRIPTION OF THE DRAWINGS

FIG. 1 is a top view of a bridge plate without showing a cushion pad beneath it;

FIG. 2 is a side elevation view of a bridge plate and cushion pad assembled;

FIG. 3 is a bottom view of a bridge plate without a cushion pad in the cushion receptacle;

FIG. 4 is an enlarged side view that has been cut away in part to show portions of a cushion pad inside and outside of a cushion receptacle;

FIG. 8 is a bottom view of a cushion pad of the type illustrated in FIG. 6 that is separate frown the bridge plate;

FIG. 9 is a side elevation view of the FIG. 8 illustration;

FIG. 10 is an enlarged sectional view of a cushion pad of the type shown in FIG. 6 that is partly separated from the bridge plate;

FIG. 11 is a separate end elevation view of the cushion pad that is shown in FIGS. 8–10;

FIG. 12 is a separate bottom view of the cushion pad shown in FIG. 7. It has been cut away in part to show sections of the cushion pad which are insertable into and which remain outside of a cushion receptacle;

FIG. 13 is an enlarged sectional view of a cushion pad of the type shown in FIG. 7 that is partly separated from the bridge plate;

FIG. 14 is an end view of the cushion pad shown in FIGS. 12 and 13;

FIG. 15 is a front view of the brassiere-shoulder-strap support attached to a front portion of a brassiere and positioned on a dashed-line outline of a front portion of a woman;

FIG. 16 is a rear view of the brassiere-shoulder-strap support attached to a rear portion of a brassiere and positioned on a dashed-line outline of a rear portion of a woman;

DESCRIPTION OF THE PREFERRED EMBODIMENT

Figure 5:
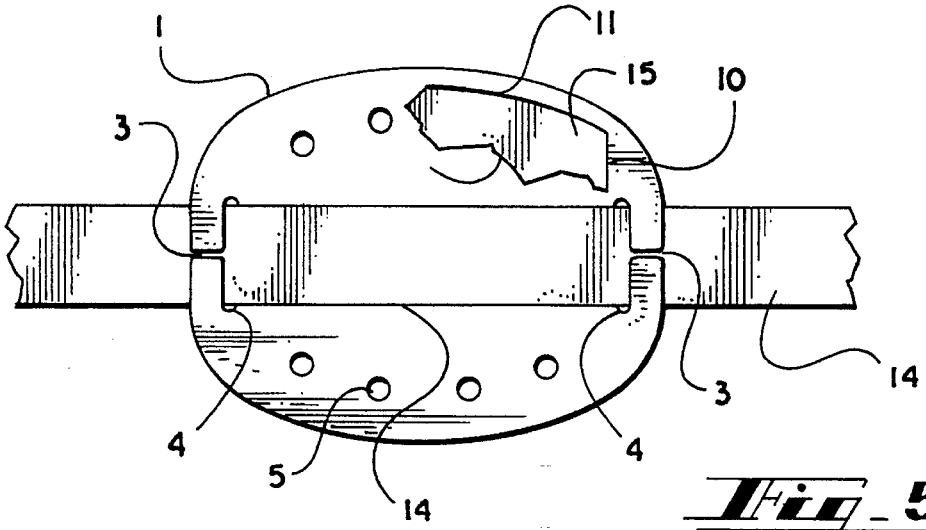
FIG. 5 is a top view with a brassiere strap attached and cut away in part to show a cushion pad from the top within the cushion receptacle.

Referring to the drawings wherein like reference numerals designate corresponding parts throughout the several figures, reference is made to FIG. 1 showing a bridge plate 1 which is sized and shaped to form-fit the top of a woman's shoulder tinder a brassiere strap. It is referred to as a bridge plate 1 because it distributes weight from a brassiere strap evenly over a broad portion of the woman's shoulder in a uniform manner like a bridge. The bridge plate 1 is constructed preferably from a light plastic material that is sufficiently rigid to distribute such weight evenly and yet not so rigid that it does not bend resiliently in response to anticipated movement of the woman's shoulder.

Shape of the bridge plate 1 is preferably elongate with a modified elliptical form. Other elongate shapes also can be employed. Length of the bridge plate 1 is sufficient to extend from desired proximity to the clavicle bone to desired proximity to a top-rear portion of the woman's shoulder. The size and the length-to-width proportions can vary considerably for different women and for different use conditions. Large, medium and small sizes of the bridge plate are foreseeable.

Thickness of the bridge plate 1 also can be different for different women and for different use conditions. Different sizes can be constructed with different thicknesses.

At each opposite end of the bridge plate 1 is a brassiere-shoulder-strap-attachment means 2. The brassiere-shoulder-strap-attachment means 2 is preferably a T-shaped strap bay comprised of a strap-entrance section 3 that is parallel to an elongate axis of the bridge plate 1 and a strap-container section 4 that is perpendicular to the strap-entrance section 3. A brassiere strap is slid in sideways through the strap-entrance section 3 and then turned parallel to the strap-container section 4.

Ventilation orifices 5 can be provided in the bridge plate 1. The same ventilation orifice 5 or separate orifices can be provided with appropriate sizes for attaching material such as lace and fragrance packets.

Referring now to FIG. 2, a cushion pad 6 can be removably attached to a bottom side 7 of the generally concave bridge plate 1. This support for a brassiere shoulder strap is comprised primarily of the bridge plate 1 and the cushion plate 6. The bridge plate 1 distributes weight over a wide area and the cushion pad 6 softens contact between a woman's shoulder and the bridge plate 1.

Thickness of the cushion pad 6 depends to a great extent on its resilient resistance to collapse or softness. Different levels of softness are preferred for different women and for different use conditions.

Material for construction of the cushion pad 6 has several preferred characteristics or specifications. It can be washed easily without retaining adverse odors or colors. It does not wear out soon from being washed and replaced often in the same or different brasseries. It has a resiliency which is sufficient to bear weight placed on the bridge plate 1 without collapsing to where the bridge plate 1 comes in contact with a woman's shoulder. The resiliency does not diminish with repeated washing and wearing throughout its use life. It has relatively "non-skid" contact with skin on a woman's shoulder to prevent it and a brassiere strap on it from sliding off of a woman's shoulder.

Referring to FIGS. 2 and 3, the cushion pad 6 is removably placeable in a cushion receptacle 8 in the concave bottom side 7 of the bridge plate 1. The cushion receptacle 8 has a receptacle bottom 0, receptacle ends walls 10 and receptacle side walls 11. The ventilation orifices 5 extend into the cushion receptacle 8. The brassiere-shoulder-strap-attachment means 2 are proximate receptacle end walls 10.

In FIG. 4 there is shown at least two walls of the cushion receptacle, preferably receptacle end walls 10 have retainer recesses 12. Pad dovetail walls 13 are sized and shaped to fit against the retainer recesses 12 in dovetail-interlocking relationship.

A brassiere shoulder strap 14, as seen in FIG. 5, is placed on top of the bridge plate 1 and positioned in the strap-container section 4 at each opposite end of the bridge plate 1. In a cutaway section extending through a receptacle bottom 9, cushion bottom 15 is revealed.

Figure 6:
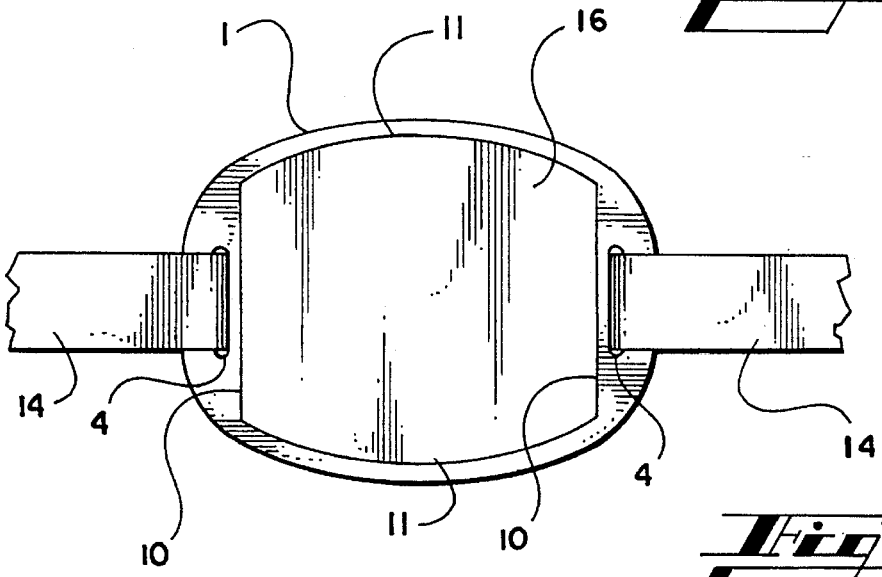
FIG. 6 is a bottom view of a bridge plate and a cushion pad assembled and with a brassiere strap attached.

Referring to FIG. 6, a top 16 of the cushion pad 6 can be seen from a bottom view. A brassiere shoulder strap 14 is extended down and out through the strap-container sections 4 and onto a woman's shoulder.

Figure 7:
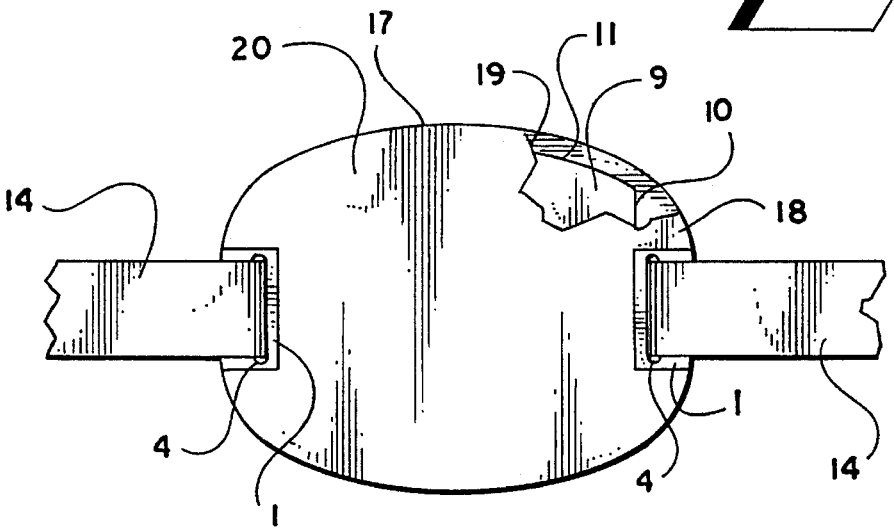
FIG. 7 is a bottom view of an optional cushion pad that covers more of a bottom of a bridge plate than the FIG. 6 embodiment. A brassiere strap is attached.

It can been seen in FIG. 7 that a full-bottom cushion pad 17 has overlap end sections 18 and overlap side sections 10. The overlap end sections 18 and overlap side sections 19 extend beyond receptacle end walls 10 and receptacle side walls 11 respectively. A bottom 20 of a full-bottom cushion pad 17 can be made to cover an entire bottom side 7 (see FIGS. 2 and 4) of a bridge plate 1 except for portions immediately surrounding the strap-container sections 4.

Referring to FIGS. 8–11, a cushion pad 6 is shown separately in FIG. 8 from the bottom, in FIG. 9 from the side and in FIG. 11 from an end. In FIG. 10, the pad dovetail wall 13 is shown separated from the retainer recess 12. A cushion boss 21 is shown in FIGS. 10 and 11 as a portion of the cushion pad 6 which extends beyond the bridge plate 1 in contact with a woman's shoulder.

In FIGS. 12–14 the full-bottom cushion pad 17 is shown separately from a cushion bottom 20 in FIG. 12, separately from an end in FIG. 14 and separated from the retainer recess 12 in FIG. 13. In FIG. 12, an overlap end section 18 and an overlap side section 19 are shown extending from a receptacle section 22 of the full-bottom cushion pad 17. Between overlap end sections 18 is strap-recess section 23 that is shown in FIGS. 12 and 14. In FIG. 13, an overlap end section 18 is shown in slidable contact with a bottom side 7 of a bridge plate 1 as pad dovetail walls 13 are brought in contact with a retainer recess 12 for attaching the cushion pad 17. For removing the full-bottom cushion pad 17 or the cushion pad 6, the pad dovetail walls 13 are removed from contact with the retainer recess 12 by grasping either cushion pad 6 or 17 and pulling it outwardly.

Either of the cushion pads 6 and 17 can be adhesively attached to the cushion receptacle 8 if desired. For adhesive attachment, characteristics of the adhesive employed are compatible with characteristics of the cushion pads. Preferably, both are washable and odor-resistant.

Referring to FIG. 15, a brassiere shoulder strap 14 is shown attached to a front portion of a brassiere 24. The brassiere shoulder strap 14 is shown on the bridge plate 1 resting on a shoulder 25 of a woman seen in part from a front view.

Referring to FIG. 16, a brassiere shoulder strap 14 in a rear view of a woman is shown attached to a rear portion of a brassiere 26. The brassiere shoulder strap 14 is shown on the bridge plate 1 resting on the shoulder 25 of the woman.

It can be seen from comparing FIGS. 15 and 16 that there is a slight difference in the distance of extension of the bridge plate 1 over the front of the shoulder 25 in comparison to the rear of the shoulder 25. This is optional and adjustable. It also demonstrates optional differences in elongate lengths of bridge plate 1 and cushion pads 6 or 16 that are removably placeable in it.

Figure 17:
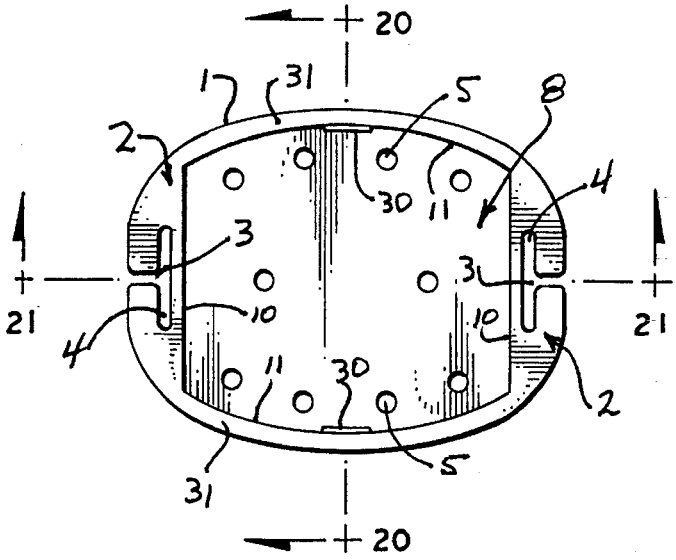
FIG. 17 is a bottom view of another embodiment of a bridge plate without showing the cushion pad beneath it.
Figure 18:
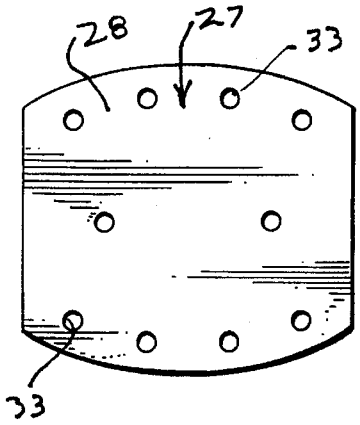
FIG. 18 is a top view of a cushion pad that fits the bridge plate shown in FIG. 17.
Figure 19:
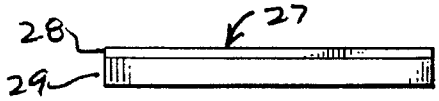
FIG. 19 is a side elevation view of the cushion shown in FIG. 18.

In another embodiment of the invention as shown in FIG. 17, the bridge plate 1 is shown in the same oval configuration with the brassiere-shoulder-strap-attachment means 2, strap-entrance section 3 and strap-container section 4 on each end. Looking at the bottom of the bridge plate in FIG. 17, the cushion receptacle 8 holds the modified cushion 27 therein. The modified pad 27 comprises a two-part construction, namely, the hard, preferably plastic, backing material 28 and a softer foam cushion pad 29. The modified pad 27 preferably has therein a plurality of holes 33, matching the spacing of holes 5 of the bridge plate, to provide ventilation.

Figure 20:
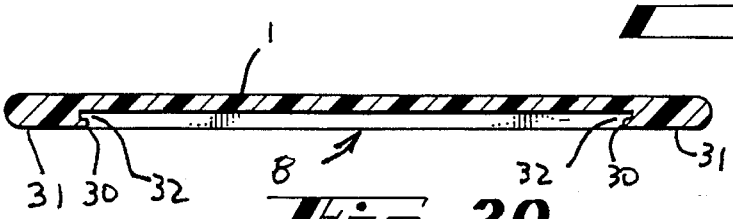
FIG. 20 is a vertical section view taken along lines 20—20 of FIG. 17.
Figure 21:
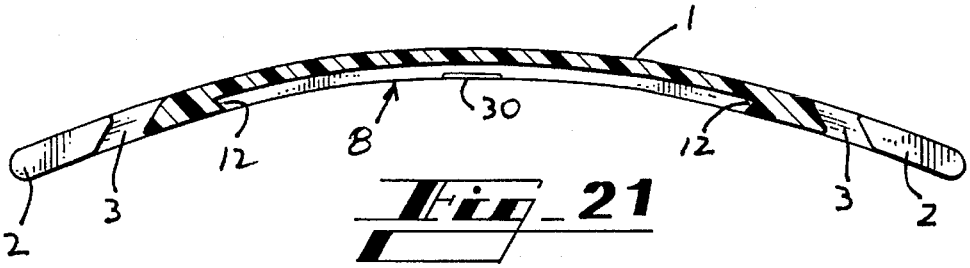
FIG. 21 is a vertical section view taken along lines 21—21 of FIG. 17.

The bridge plate 1 of FIG. 17 has retainer recesses 12 at each end of the long direction of the plate, and on the sides of the plate there are one or more retainer gripping tabs 30 which project inwardly from the rim of the plate 31 along side walls 11. As more readily seen in the vertical cross-section in FIG. 20, the retainer tabs 30 form a retainer recess 39 between the tabs 30 and the cushion receptacle area 8. The retainer recess 32 operates to engage the edge of the back 28 of the cushion 27 within the retainer recess 32 so that the cushion pad is not only held on the ends of the plate by means of the retainer recesses 12, but is also snapped into firm engagement with the plate by means of the retainer gripping tabs 30.

Figure 22:
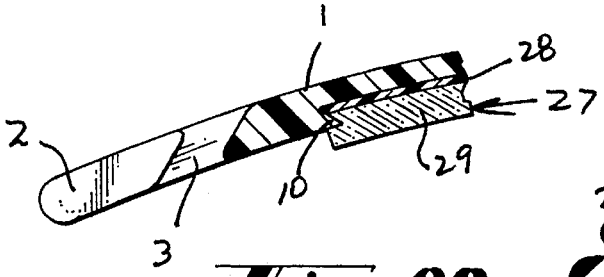
FIG. 22 is a partial vertical section view taken along lines 21—21 of FIG. 17 showing, however, the cushion pad of FIG. 18 placed in the bottom of the bridge plate.
Figure 23:
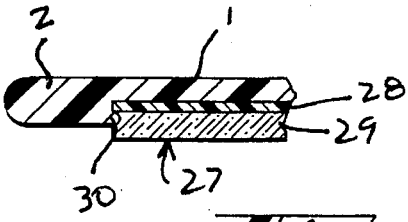
FIG. 23 is a partial vertical section view taken along lines 20—20 of FIG. 17 showing, however, the cushion pad of FIG. 18 placed in the bottom of the bridge plate.

Therefore, as can be seen in FIG. 22, at the ends of the bridge plate 1, the cushion pad 27 is snapped into the retainer recesses 12 and the receptacle end walls 10 hold the back 28 and engages the soft foam of the cushion pad 20 to maintain firm engagement on the ends of the bridge plate. As can be seen in FIG. 23, the cushion pad 27 is maintained in the bridge plate 1 by engagement of the retainer tabs 30 with the back 28, and the tabs 30 also engage the cushion pad 29. It can be seen that with this particular arrangement that there is little chance, if any, that the cushion pad 27 will be dislodged by activities of the person wearing the bridge plate. To mount the cushion pad 27 into the bridge plate, it is merely necessary to place the cushion pad over the area 8 and then press upon each end to snap the back 28 under retainer recesses 12, and then press the side edges of the pad to snap the back 28 under retainer tabs 30.

It is contemplated that all materials utilized in a bridge plate 1, and the various cushion pads disclosed herein, will be of medical grade materials and be non-hypo-allergenic.

Various modifications may be made of the invention without departing from the scope thereof and it is desired, therefore, that only such limitations shall be placed thereon as are imposed by the prior art and which are set forth in the appended claims.

What is claimed is:

1. A brassiere-shoulder-strap support comprising:

a pliant bridge plate having first and second opposite ends and an elongate curvature which conforms to a portion of a woman's shoulder between a position proximate a clavicle bone and a top-rear portion of the woman's shoulder, the bridge plate having an upper surface and a lower surface, a bridge-plate width greater than a width of a brassiere shoulder strap that is placeable on the bridge plate, a cushion receptacle having multiple receptacle walls and a bottom surface, said walls further extending from the lower surface of the bridge plate to and intersecting with the bottom surface of the bridge plate, one receptacle wall of the cushion receptacle is recessed at an end of the cushion receptacle that is proximate a brassiere-shoulder-strap-attachment means that is proximate the first of the two opposite ends of the bridge plate and another receptacle wall of the cushion receptacle is recessed at an end of the cushion receptacle that is proximate a brassiere-shoulder-strap-attachment means that is proximate the second of the two opposite ends of the bridge plate, a cushion pad removably placeable in the cushion receptacle, a receptacle side of the cushion pad is placeable on a bottom surface of the cushion receptacle, edges of the cushion pad are positioned in contact with the receptacle walls of the cushion receptacle and a cushion side of the cushion pad is extended from the cushion receptacle past the lower surface of the bridge plate to be placeable on the woman's shoulder in cushioning relationship between the bridge plate and the woman's shoulder, a brassiere-shoulder-strap-attachment means proximate each of two opposite ends of the bridge plate, and the cushion pad sized and shaped to be positioned in contact with the recessed walls of the cushion receptacle in dovetail-interlocking relationship to hold the cushion pad in the cushion receptacle.

2. A brassiere-shoulder-strap support as claimed in claim 1, wherein the cushion pad has beveled edges or, opposite ends thereof, the beveled edges are placed in a dovetail-interlocking relationship with recessed opposite ends of the cushion receptacle proximate brassiere-shoulder-strap-attachment means proximate opposite ends of the bridge plate.

3. A brassiere-shoulder-strap support as claimed in claim 1, wherein the pliancy of the bridge plate is sufficient to distribute weight selectively over a portion of the woman's shoulder to which the elongate curvature of the bridge plate conforms.

4. A brassiere-shoulder-strap support as claimed in claim 3, wherein the pliancy of the bridge plate is sufficient to prevent bending of the bridge plate by a bending moment applied by movement of the shoulder by the woman.

5. A brassiere-shoulder-strap support as claimed in claim 1, wherein thickness and compressive resistance of the cushion pad combined provides resistance to complete collapse of the cushion pad.

6. A brassiere-shoulder-strap support as claimed in claim 1, wherein the cushion pad is constructed of a resilient material and is cleanable without loss of shape and structural integrity for replacement and reuse in the bridge plate.

7. A brassiere-shoulder-strap support as claimed in claim 1, wherein the cushion pad has an attachment side the attachment side having an adhesive placed thereon, the cushion pad being adhesively attached to the bottom surface of the cushion receptacle.

8. A brassiere-shoulder-strap support as claimed in claim 7, wherein the cushion pad is constructed of a resilient material which is cleanable while adhesively-attached to the cushion receptacle without loss of resiliency, shape and structural integrity from being cleaned while adhesively-attached to the cushion receptacle.

9. A brassiere-shoulder-strap support as claimed in claim 7, wherein the adhesive with which the cushion pad is adhesively-attachable to the bottom surface of the cushion receptacle is an adhesive material which does not absorb dirt, oils and odors encountered in relation to intended uses of this brassiere-shoulder-strap support.

10. A brassiere-shoulder-strap support as claimed in claim 1, wherein the brassiere-shoulder-strap-attachment means proximate each of the two opposite ends of the bridge plate includes a T-shaped strap bay having a strap-entrance section parallel to an elongate axis of the bridge plate and a strap-container section perpendicular to the strap-entrance section of the T-shaped strap bay.

11. A brassiere-shoulder-strap support as claimed in claim 1 and further comprising vent orifices in the bridge plate.

12. A brassiere-shoulder-strap support as claimed in claim 1 and further comprising decoration-attachment orifices in the bridge plate.

13. A brassiere-shoulder-strap support as claimed in claim 1, wherein the cushion pad is extended laterally and perpendicularly from the cushion receptacle such that the cushion pad is placed in juxtaposition with the receptacle walls.

14. A brassiere-shoulder-strap support as claimed in claim 1, wherein the cushion pad is extended laterally and perpendicularly from the cushion receptacle such that the cushion pad covers the receptacle walls arid covers the bottom surface of the cushion receptacle.

15. A brassiere-shoulder-strap support comprising:

a pliant bridge plate having first and second opposite ends and an elongate curvature which conforms to a portion of a woman's shoulder between a position proximate a clavicle bone and a top-rear portion of the woman's shoulder, the bridge plate having an upper surface and a lower surface, a bridge-plate width greater than a width of a brassiere shoulder strap that is placeable on the bridge plate, a cushion receptacle having at least first and second receptacle walls and a bottom surface, the first and a second said receptacle walls are recessed, said receptacle walls extending from the lower surface of the bridge plate to the bottom surface of the bridge plate, a cushion pad removably placeable in the cushion receptacle, a brassiere-shoulder-strap-attachment means located in juxtaposition with the two opposite ends of the bridge plate, the first and second receptacle walls being located proximate to respective first and second opposite ends of the bridge plate, a receptacle side of the cushion pad placeable on the bottom surface of the cushion receptacle, edges of the cushion pad positioned in contact with the receptacle walls of the cushion receptacle, a cushion side of the cushion pad extended from the cushion receptacle past the lower surface of the bridge plate to be placeable on the woman's shoulder in cushioning relationship between the bridge plate and the woman's shoulder, beveled edges on opposite ends of the cushion pad that are sized and shaped to be positioned in contact with the recessed walls of the cushion receptacle in interlocking relationship to hold the cushion pad in the cushion receptacle, the pliancy of the bridge plate being sufficient to distribute weight selectively over a portion of the woman's shoulder to which the elongate curvature of the bridge plate conforms, thickness and compressive resistance of the cushion pad being of sufficient resistance to collapse of the cushion pad to prevent the cushion pad from collapsing from weight supported by the brassiere strap, the cushion pad being constructed of resilient material, material from which the cushion pad is constructed being cleanable with without loss of shape and structural integrity for replacement and reuse in the bridge plate, and the brassiere-shoulder-strap-attachment means having a T-shaped strap bay, the T-shaped strap bag having a strap-entrance section parallel to an elongate axis of the bridge plate and a strap-container bay perpendicular to the T-shaped strap bay.

16. A brassiere-shoulder-strap support as claimed in claim 15, wherein the cushion pad is extended laterally and perpendicularly from the cushion receptacle such that the cushion pad covers the receptacle walls of the cushion receptacle.

17. A brassiere-shoulder-strap support comprising:

a pliant bridge plate having an elongate curvature which conforms to a portion of women's shoulder between a position proximate a clavicle bone and a top-rear portion of the women's shoulder, a bridge plate having a width greater than a width of a brassiere shoulder strap that is placeable on the bridge plate, the bridge plate further having a top surface and a bottom surface, the bottom surface being co-extensive to the elongate curvature, the bottom surface having a cushion receptacle, the cushion receptacle having a pair of end walls and a pair of side walls, the end walls and the side walls extending from the lower surface of the bridge plate to and intersecting with the bottom surface of the bridge plate, a cushion pad removably placeable in the cushion receptacle, the cushion pad comprising a stiff top surface and a resilient bottom surface, the cushion receptacle having means to retain the cushion pad therein, the cushion receptacle means comprising end wall gripping recesses and side wall gripping surfaces to grip the cushion pad to maintain the cushion pad within the receptacle in juxtaposition with the bottom surface of the bridge plate, the stiff top surface of the cushion pad adapted to be engaged with the recesses of the end walls and with the gripping surfaces of the side walls.

18. A brassiere-shoulder-strap support as claimed in claim 17 wherein the end walls of the cushion receptacle are recessed.

19. A brassiere-shoulder-strap support as claimed in claim 17, wherein the side walls of the cushion receptacle each have at least one gripping surface extending therefrom.

20. A brassiere-shoulder-strap support as claimed in claim 17, wherein the bridge plate has a plurality of vent orifices therein.

21. A brassiere-shoulder-strap support as claimed in claim 17, wherein the cushion pad has a plurality of vent orifices therein.

22. A brassiere-shoulder-strap support as claimed in claim 17 wherein the gripping surfaces of the side walls project outwardly from the side walls to receive the stiff top surface of the cushion pad between the gripping surfaces and the bottom surface of the bridge plate.

* * * * *